US006700049B2

(12) United States Patent
Togashi

(10) Patent No.: US 6,700,049 B2
(45) Date of Patent: Mar. 2, 2004

(54) MUSIC DATA PROVIDING APPARATUS, MUSIC DATA RECEIVING APPARATUS, MUSIC DATA REPRODUCING APPARATUS, AND MUSIC DATA PROVIDING METHOD

(75) Inventor: Yuuichi Togashi, Tokyo (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 171 days.

(21) Appl. No.: 09/953,920

(22) Filed: Sep. 18, 2001

(65) Prior Publication Data

US 2002/0035914 A1 Mar. 28, 2002

(30) Foreign Application Priority Data

Sep. 22, 2000 (JP) ..... 2000-289523

(51) Int. Cl.[7] ..... A63H 5/00; G04B 13/00; G10H 7/00

(52) U.S. Cl. ..... 84/609; 705/27

(58) Field of Search ..... 84/609–614, 634–638; 434/307; 705/27

(56) References Cited

U.S. PATENT DOCUMENTS

| | | | | |
|---|---|---|---|---|
| 6,552,254 | B2 * | 4/2003 | Hasegawa et al. | 84/609 |
| 2001/0049641 | A1 * | 12/2001 | Nakamura et al. | 705/26 |
| 2002/0000156 | A1 * | 1/2002 | Nishimoto et al. | 84/609 |
| 2002/0032747 | A1 * | 3/2002 | Toki | 709/217 |
| 2002/0055951 | A1 * | 5/2002 | Shigetomi et al. | 707/501.1 |
| 2002/0069127 | A1 * | 6/2002 | Enari | 705/26 |

* cited by examiner

*Primary Examiner*—Jeffrey Donels
(74) *Attorney, Agent, or Firm*—Finnegan, Henderson, Farabow, Garrett & Dunner, L.L.P.

(57) ABSTRACT

There is provided a music data providing apparatus for providing a music data receiving apparatus with music data. The music data providing apparatus stores a plurality of files to which music data for a piece of music has been distributed. The music data receiving apparatus transmits the music data in units of files in accordance with a request from the music data receiving apparatus.

13 Claims, 3 Drawing Sheets

MUSIC DATA PROVIDING APPARATUS, MUSIC DATA RECEIVING APPARATUS, MUSIC DATA REPRODUCING APPARATUS, AND MUSIC DATA PROVIDING METHOD

CROSS-REFERENCE TO RELATED APPLICATIONS

This application is based upon and claims the benefit of priority from the prior Japanese Patent Application No. 2000-289523, filed Sep. 22, 2000, the entire contents of which are incorporated herein by reference.

BACKGROUND OF THE INVENTION

1. Field of the Invention

The present invention relates to a music data providing apparatus, a music data receiving apparatus, a music data reproducing apparatus, and a music data providing method.

2. Description of the Related Art

In recent years, audio equipment of the type compatible with music providing service that provides music data via a network has been put on the market as new audio equipment differing from such audio equipment dealing with CDs or MDS. In a server, a large number of music data files have been stored. A user accesses the server from a cellular phone terminal or a unit with a reception function, such as a personal computer, and chooses the desired music (or number) in accordance with the guidance on the operating screen provided by the server, thereby downloading the chosen music data file from the server and storing it in the built-in memory or the like temporarily, which enables the user to reproduce the music freely later.

The music providing service has suddenly been popularized because of various merits, including the merits that users can receive the desired music whenever they want to, that they can get only the necessary piece of music, that they have only to pay the charge for each piece of music, and that they can enjoy listening to the desired pieces of music after editing them in a play list.

Although users can enjoy the various merits of music providing services as described above, there is room for improvement, when it comes to the ease of use. For instance, music data files cannot be reproduced unless the reception of all of the music data files has been completed. Therefore, there is a probability that the user will find only after the reproduction of the music following the reception that the music is not the desired one.

BRIEF SUMMARY OF THE INVENTION

Accordingly, it is an object of the present invention to provide a music data providing apparatus, a music data receiving apparatus, a music data reproducing apparatus, and a music data providing method which enable a part of music data to be provided or reproduced.

According to one aspect of the present invention, there is provided a music data providing apparatus for providing a music data receiving apparatus with music data, comprising: a storage unit configured to store a plurality of files to which music data for a piece of music has been distributed; and a transmitting unit configured to transmit the music data in units of files in accordance with a request from the music data receiving apparatus.

According to another aspect of the present invention, there is provided a music data providing apparatus for providing a music data receiving apparatus with music data, comprising: a storage unit configured to store a file having music data for a piece of music; and a transmitting unit configured to cut out a part of music data for a piece of music and transmit the part in accordance with a request from the music data receiving apparatus.

According to still another aspect of the present invention, there is provided a music data providing apparatus for providing a music data receiving apparatus with music data, comprising: a storage unit configured to store a file having music data for a piece of music, together with another file having a part of the music data for the piece of music; and a transmitting unit configured to selectively transmit at least one of the another file and the music data file in accordance with a request from the music data receiving apparatus.

According to still another aspect of the present invention, there is provided a music data receiving apparatus for receiving music data from a music data providing apparatus, comprising: a requesting unit configured to request the music data providing apparatus to transmit a part of music data for a piece of music; and a reproducing unit configured to reproduce the part of the music data for the piece of music transmitted from the music data providing apparatus.

According to still another aspect of the present invention, there is provided a music data reproducing apparatus comprising: a storage unit configured to store music data for a piece of music; and a reproducing unit configured to reproduce a part of the music data for the piece of music stored in the storage unit.

According to still another aspect of the present invention, there is provided a music data reproducing apparatus comprising: a storage unit configured to store a plurality of section data files constituting music data for a piece of music; and a reproducing unit configured to separately reproduce the plurality of section data files stored in the storage unit.

According to still another aspect of the present invention, there is provided a music data providing method for providing a music data receiving apparatus with music data from a music data providing apparatus, the method comprising: requesting a part of music data from the music data receiving apparatus to the music data providing apparatus; and transmitting the part of the music data from the music data providing apparatus to the music data receiving apparatus in accordance with a request from the music data receiving apparatus.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Hereinafter, referring to the accompanying drawings, an embodiment of the present invention will be explained.

Figure 1:
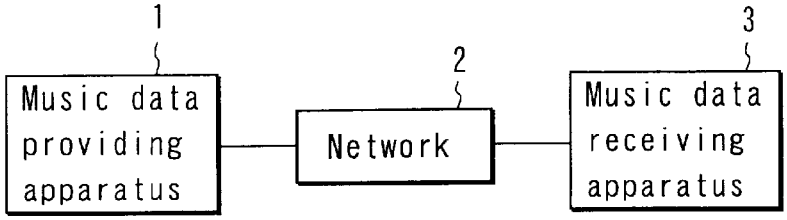
FIG. 1 shows the configuration of a music data providing system according to an embodiment of the present invention.

FIG. 1 is an overall view of a music data providing system to which the present invention has been applied. A music data receiving apparatus 3 is connected via a network 2 to a music data providing apparatus 1. The network 2 may be an ISDN public telecommunication network, a private telecommunication network, a satellite communication network, or a cellular phone wireless communication network and is not limited to a specific communication network. In addition, the music data receiving apparatus 3 is not restricted to a specific apparatus, as long as it can be connected via the network 2 to the music data providing apparatus 1. For instance, it may be a cellular phone terminal, a mobile terminal, or a computer terminal, such as a personal computer.

Figure 2:
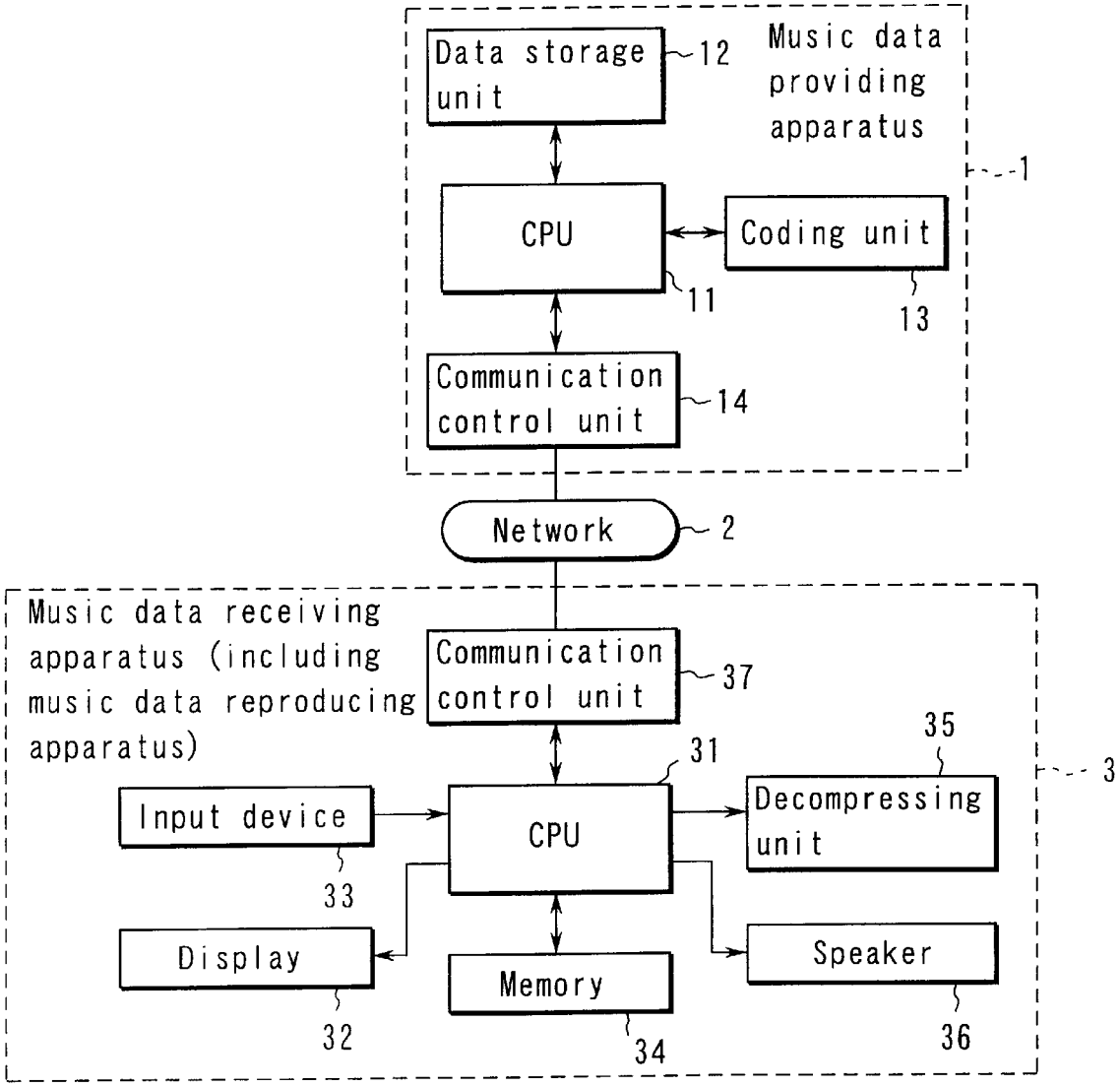
FIG. 2 shows the configuration of the music data providing apparatus and music data receiving apparatus of FIG. 1.

FIG. 2 shows the configuration of the music data providing apparatus 1 and music data receiving apparatus 3 of FIG. 1. The music data providing apparatus 1, which functions as a music data server, includes a CPU 11 and, around the CPU 11, further includes a data storage unit 12 in which music data and data about CD jacket images necessary to construct an operating screen explained later have been stored, a coding unit 13 for coding music data into a compressed data form, such as MP3 (MPEG-1 Audio Layer-III), and a communication control unit 14 for performing data transmission and reception in accordance with a determined protocol.

The music data receiving apparatus 3, which functions as a client that receives the providing of music data, includes a CPU 31 and, around the CPU 31, further includes a display 32 for displaying a number select screen or a section select screen (explained later in detail) downloaded from the music data providing apparatus 1, an input device 33, such as a keyboard, a mouse, or a cellular phone's key set, for enabling the user to enter a number select instruction or a section select instruction in accordance with the guidance on the select screen, a flash memory 34, e.g., nonvolatile, for storing the music data downloaded from the music data providing apparatus 1, a decompressing unit 35 for decompressing the downloaded compressed music data, a headphone or speaker 36 for outputting the decompressed music data, and a communication control unit 37. The music data reproducing apparatus is composed of the component parts, excluding the communication control unit 37, which are related to the reproduction of music data in the music data receiving apparatus 1.

Figure 3:
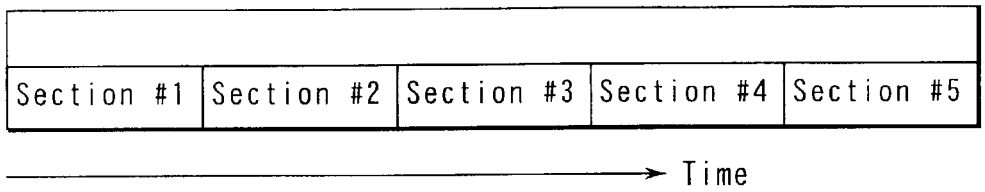
FIG. 3 is a conceptual diagram of a section data file stored in the data storage unit of the music data providing apparatus of FIG. 2.

FIG. 3 shows a data file stored in the data storage unit 12 of the music data providing apparatus 1. In the data storage unit 12, a large number of music data items have been stored in the state where each data item has been divided into a plurality of data files (section data files). A single section data file contains the data in a single section on the time axis of the music data. That is, the music data for a piece of music is completed with a plurality of section data files corresponding to a plurality of sections divided so as not to overlap with each other. In the example of FIG. 3, a piece of music is divided into five sections, #1 to #5.

The method of dividing into sections is not limited to a specific one. For instance, a piece of music may be divided at regular intervals of time or at different intervals of time so that the amount of data in each file may be constant. A code representing in what number of order of all the data items the present one lies is added to the header area of each data file. According the codes, a plurality of data files are combined to form music data for a piece of music. In addition, a flag indicating that the section is a highlight is added to the header area of the section data file for the section including the highlight part. The flag enables the section data file for the highlight section to be selectively transmitted in accordance with the request of the music data providing apparatus 1.

Figure 4:
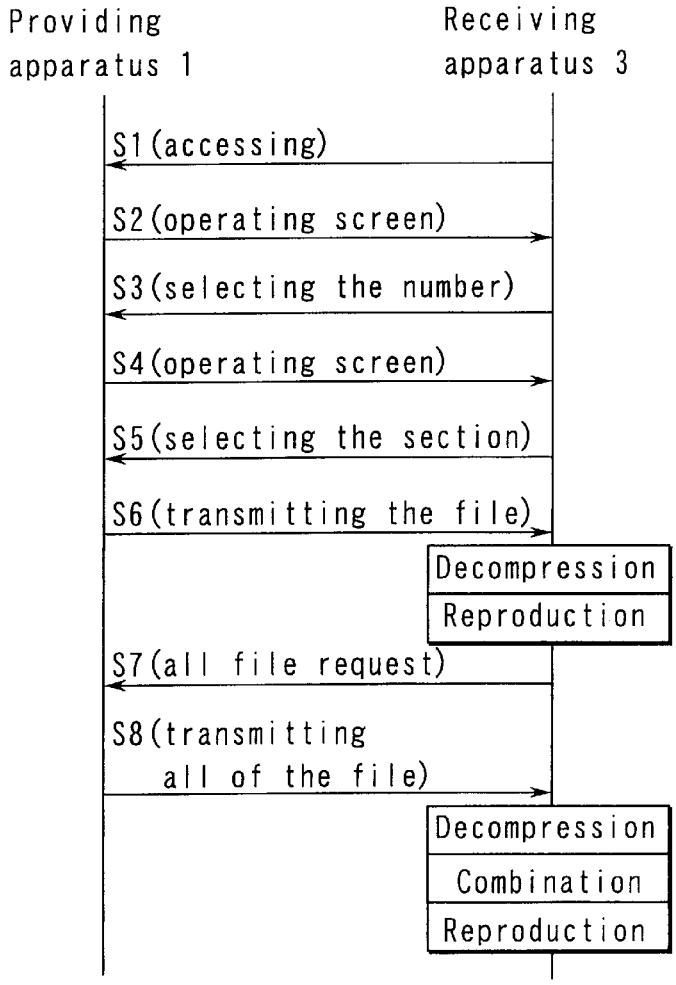
FIG. 4 is a diagram used to explain a communication operation between the music data providing apparatus and music data receiving apparatus of FIG. 1.
Figure 5:
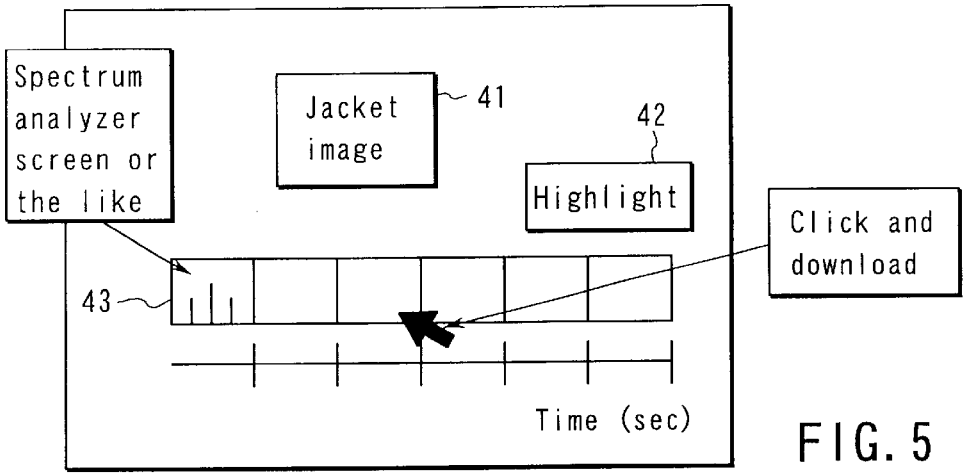
FIG. 5 shows an example of an operating screen for selecting a section in FIG. 4.

FIG. 4 shows the procedure for communication between the music data providing apparatus 1 and music data receiving apparatus 3. When being accessed by the music data receiving apparatus 3 (step S1), the music data providing apparatus 1 transmits screen data for selecting a piece of music, including, e.g., a number list to the music data receiving apparatus 3 (step S2). When the user has selected the desired number from the number select screen, the code data for the selected piece is sent to the music data providing apparatus 1 (step S3). Then, the music data providing apparatus 1 transmits the data for a section select operating screen, as shown in FIG. 5, to the music data receiving apparatus 3 (step S4).

The operating screen is made up of a CD jacket image 41, a highlight download request button 42, and section select buttons 43 using, e.g., HTML. Each of the section select buttons 43 is especially provided with, e.g., an image of a frequency spectrum of the music data in the corresponding section serving as judging material to help the user select the section to be downloaded.

When the user clicks a section select button 43 on the section select screen and then clicks the desired section or the highlight download request button 42 to select the highlight section, the code data for that section is sent to the music data providing apparatus 1 (step S5). In response to this, the CPU 11 of the music data providing apparatus 1 reads the section data file for the corresponding piece of the music and the corresponding section from the storage unit 12 and transmits the file via the communication control unit 14 to the music data receiving apparatus 3 (step S6).

In the music data receiving apparatus 3, the section data file downloaded from the music data providing apparatus 1 is stored in the memory 34 temporarily. Then, according to a reproducing instruction, the file is sent to the decompressing unit 35, which decodes it. The result is sent via a D/A converter (not shown) to the speaker 36, which reproduces it.

When listening to the piece of music in the section and finding that it is the desired one, the user transmits an all file request to the music data providing apparatus 1 (step S7). When trying to listen to another piece of music, the user goes back to step S3 and executes the same operation. Moreover, when wanting to listen to a piece of music in another section, the user returns to step S6 and selects another section.

There may a case where the user does not want to download all the files. For instance, it may be a case where only one section (e.g., the highlight section) is used as a call incoming tone or a case where the user wants to reproduce only one section (e.g., the highlight section) of each of a plurality of pieces of music consecutively in the form of thumbnails. In such a case, the communication is disconnected at the time when the downloading of the data file in the desired section has been completed.

When receiving the all file request from the music data receiving apparatus 3, the CPU 11 of the music data providing apparatus 1 reads the ones of all the section data files constituting the piece of music excluding the already downloaded ones from the storage unit 12 and transmits them one after another via the communication control unit 14 to the music data receiving apparatus 3 (step S8).

The music data receiving apparatus 3 stores the section data files downloaded from the music data providing apparatus 1 into the memory 34 temporarily. Then, according to the reproducing instruction, the files are read into the decompressing unit 35, which decodes them. According to the order codes in the header areas, the decoded data items are combined to form the data for a piece of music. The resulting data is sent via a D/A converter (not shown) to the speaker 36, which reproduces it.

As described above, with the embodiment, before downloading all the piece of music to be downloaded, the user can receive the data in one section of the piece of music, try listening to only the one section, and check to see if it is the desired piece of music. This alleviates the burden on the user in terms of time and charge. Since one piece of music is divided into a plurality of section data files, even if the communication is disconnected suddenly in the course of downloading a file, only the file must be downloaded again.

Figure 6:
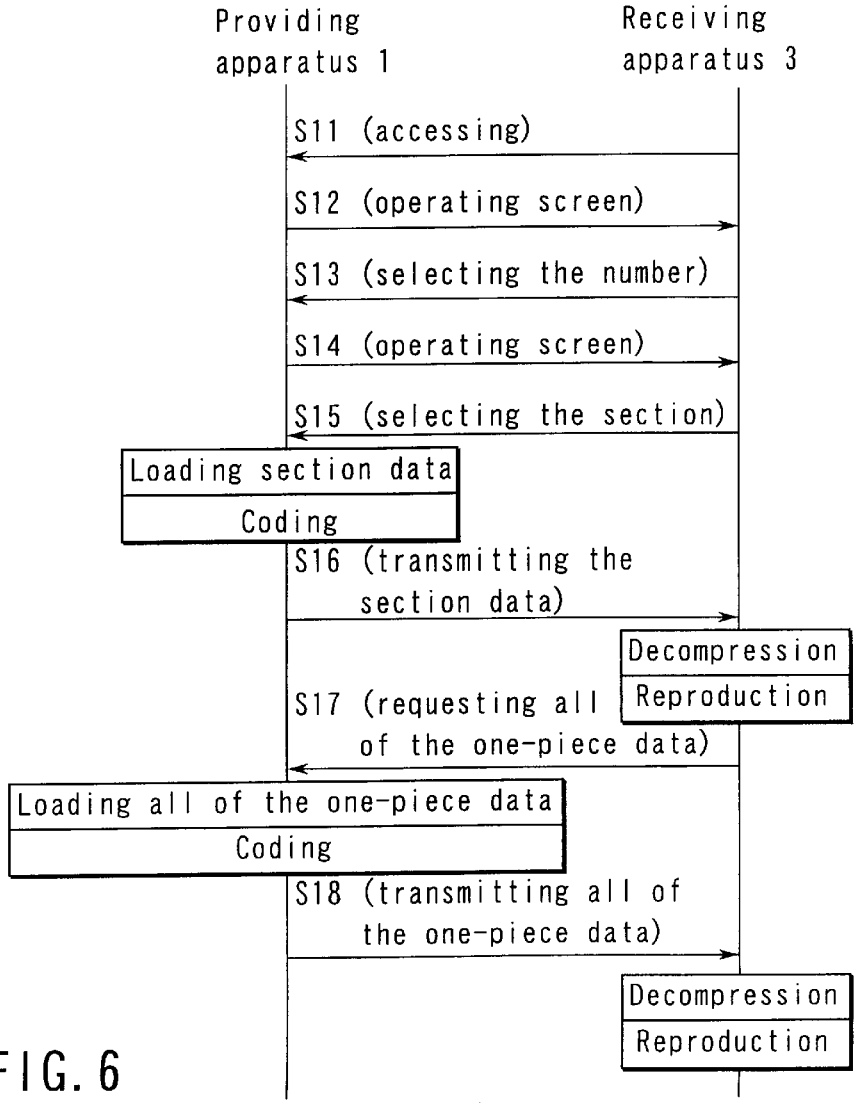
FIG. 6 is a diagram used to explain another communication operation between the music data providing apparatus and music data receiving apparatus of FIG. 1.

In the explanation, a data file has been created for each section and stored in the data storage unit 12. Then, the data has been transmitted in units of files in accordance with the user's request. Instead, music data for a piece of music may be stored as a single file in the data storage unit 12. Then, when the user requests section data, the data in the corresponding section may be cut out from the file and transmitted. FIG. 6 shows the procedure for communication between the music data providing apparatus 1 and music data receiving apparatus 3 in this case. When being accessed by the music data receiving apparatus 3 (step S11), the music data providing apparatus 1 transmits screen data for selecting a piece of music, including, e.g., a number list (step S12). When the user has selected the desired number from the number select screen, the code data for the selected piece is sent to the music data providing apparatus 1 (step S13). Then, the music data providing apparatus 1 transmits the data for a section select operating screen, as shown in FIG. 5, to the music data receiving apparatus 3 (step S14).

Then, when the user chooses the desired section (or highlight section) on the section select screen, the code data in the section is sent to the music data providing apparatus 1 (step S15). In response to this, the CPU 11 of the music data providing apparatus 1 cuts out the data in the specified section from the music data file having the relevant piece of music and loads only that part. The section data is compressed (or coded) at the coding unit 13. The coded data is transmitted via the communication control unit 14 (step S16).

The section data may be given beforehand to the header area of the music data file and the highlight section be recognized in accordance with the section data. Alternatively, the CPU 11 may recognize automatically the high part of the sound volume, interval, or output level, or further the large part of the change in each of them as the highlight section.

The music data receiving apparatus 3 stores the section data file downloaded form the music data providing apparatus 1 into the memory 34 temporarily. According to a reproducing instruction, the section data file is sent to the decompressing unit 35, which decodes it. The decoded data is sent via a D/A converter (not shown) to the speaker 36, which reproduces it. The user listens to the music in the corresponding section. If judging that it is the desired one, the user transmits a one-piece data request to the music data providing apparatus 1 (step S17). Receiving the one-piece data request from the music data providing apparatus 3, the CPU 11 of the music data providing apparatus 1 reads the data file having the music data for the corresponding piece from the storage unit 13 and transmits it in a lump via the communication control unit 14 to the music data receiving apparatus 3 (step S18). The music data receiving apparatus 3 stores the data file having a piece of music downloaded from the music data providing apparatus 1 into the memory 34 temporarily. Then, according to the reproducing instruction, the data file is decoded at the decompressing unit 35. The result is sent via a D/A converter (not shown) to the speaker 36, which reproduces it.

Instead of dividing the music data into a plurality of section data files and storing them in the data storage unit 12, the music data for a piece of music may be stored in a single file and the data in the corresponding section be cut out from the file and transmitted when the user requests the section data. This approach may produce the same effect as described above. That is, the user can try listening to one section of the desired piece of music and then downloads all the data for that piece.

When the user uses only one section (e.g., the highlight section) as a call incoming tone or reproduces only one section (e.g., the highlight section) of each of a plurality of pieces of music consecutively in the form of thumbnails, the music data receiving apparatus 3 may carry out the necessary processes. In this case, all the music data for one piece of music is first stored in the storage section of the memory 34 of the music data receiving apparatus 3. Then, the CPU 31 divides the music data for one piece into a plurality of section data files and stores them in another storage area of the memory 34. A highlight flag is added to the header area of the section data file corresponding to the highlight section. In this method, the user may try listening to the relevant piece of music and manually add a highlight flag to that section data file. Alternatively, the CPU 31 may recognize automatically the high part of the sound volume, interval, or output level, or further the large part of the change in each of them as the highlight section as described above.

In this way, dividing the music data for one piece of music into a plurality of section data files enables a part of the music data to be handled in units of section data files. Therefore, for instance, the user clicks the section select button 43 on the operating screen as shown in FIG. 5 or clicks the highlight download request button 42, thereby making it possible to reproduce only the music data in the desired section freely. This enables the user to use only the desired section (e.g. the highlight section) as a call incoming tone or do settings so as to reproduce only one section (e.g., the highlight section) of each of a plurality of pieces of music consecutively in the form of thumbnails and listen to them.

The present invention is not limited to the embodiment and may be practiced or embodied in still other ways without departing from the spirit or essential character thereof.

As described above in detail, with the present invention, since the music data is divided into a plurality of files and then the files are stored, the music data can be provided in units of files in accordance with the request of the music data receiving apparatus.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A music data providing apparatus for providing a music data receiving apparatus with music data, comprising:

a storage unit configured to store a plurality of section data files music data for a piece of music has been distributed corresponding to a plurality of sections of a piece of music;

a screen data transmitting unit configured to transmit data for a screen on which one of the plurality of sections of the piece of music is selectable; and a section data transmitting unit configured to read a section data file, which corresponds to a section selected on the screen, from the storage unit and transmit the section data file to the music data receiving apparatus.

2. The music data providing apparatus according to claim 1, wherein a highlight flag is added to a header area of a specific one of the plurality of section data files.

3. A music data providing apparatus for providing a music data receiving apparatus with music data, comprising:

a storage unit configured to store a file having music data for a piece of music;

a screen data transmitting unit configured to transmit data for a screen on which one of the plurality of sections of the piece of music is selectable; and a section data transmitting unit configured to cut out section data, which corresponds to a section selected on the screen from the file stored by the storage unit and transmit the section data to the music data receiving apparatus.

4. A music data providing apparatus for providing a music data receiving apparatus with music data, comprising:

a storage unit configured to store a music data file having music data for a piece of music, together with a section data file having a part of the music data for the piece of music;

a screen data transmitting unit configured to transmit data for a screen on which at least one of the plurality of sections of the piece of music is selectable; and a music data transmitting unit configured to read at least one of the section data file and the music data file, which corresponds to a selected one on the screen from the storage unit and transmit the at least one of the section data file and the music data file to the music data receiving apparatus.

5. A music data receiving apparatus for receiving music data from a music data providing apparatus, comprising:

an access unit configured to access the music data providing apparatus to obtain data;

a screen data receiving unit configured to receive, from the music data providing apparatus, data for a screen on which one of a plurality of sections of a piece of music is selectable;

a requesting unit configured to request the music data providing apparatus to transmit a section data file which corresponds to a section selected on the screen;

a section data receiving unit configured to receive the section data file transmitted from the music data providing apparatus; and a reproducing unit configured to reproduce the section data file transmitted from the music data providing apparatus.

6. The music data receiving apparatus according to claim 5, further comprising a storage unit configured to store the section data file transmitted from the music data providing apparatus before the reproduction.

7. A music data providing system including a music data providing apparatus and a music data receiving apparatus, the system comprising:

a storage unit, provided in the music data providing apparatus, configured to store a plurality of section data files corresponding to a plurality of sections of a piece of music;

an access unit, provided in the music data receiving apparatus, configured to access the music data providing apparatus to obtain data;

a screen data transmitting unit, provided in the music data providing apparatus, configured to transmit data for a screen on which one of the plurality of sections of the piece of music is selectable;

a screen data receiving unit, provided in the music data receiving apparatus, configured to receive, from the music data providing apparatus, the data for the screen on which one of the plurality of sections of the piece of music is selectable;

a requesting unit, provided in the music data receiving apparatus configured to request the music data providing apparatus to transmit a section data file which corresponds to a section selected on the screen;

a section data transmitting unit, provided in the music data providing apparatus, configured to read a section data file, which corresponds to a section selected on the screen, from the storage unit and transmit the section data file to the music data receiving apparatus;

a section data receiving unit configured to receive the section data file transmitted from the music data providing apparatus; and a reproducing unit, provided in the music data receiving apparatus configured to reproduce a the section data file transmitted from the music data providing apparatus.

8. The music data providing system according to claim 7, further comprising a storage unit, provided in the music data receiving apparatus configured to store the section data file transmitted from the music data providing apparatus before the reproduction.

9. The music data receiving apparatus according to claim 5 further comprising:

a storage unit configured to store the plurality of section data files constituting the music data for the piece of music transmitted from the music data providing apparatus; and a reproducing unit configured to separately reproduce the plurality of section data files stored in the storage unit in accordance with a section selecting operation on the screen.

10. The music data reproducing apparatus according to claim 9, wherein a highlight flag is added to a header area of a specific one of the a plurality of section data files.

11. A music data providing method for providing a music data receiving apparatus with music data from a music data providing apparatus, the method comprising:

storing, in a storage unit of the music data providing apparatus, a plurality of section data files corresponding to a plurality of sections of a piece of music;

transmitting, from the music data providing apparatus to the music data receiving apparatus, data for a screen on which one of the plurality of sections of the piece of music is selectable; and reading a section data file, which corresponds to a section selected on the screen from the storage unit and transmitting the section data file to the music data receiving apparatus.

12. A music data receiving method for receiving music data from a music data providing apparatus, the method comprising:

accessing the music data providing apparatus to obtain data:

receiving, from the music data providing apparatus, data for a screen on which one of a plurality of sections of a piece of music is selectable;

requesting the music data providing apparatus to transmit a section data file which corresponds to a section selected on the screen:

receiving the section data file transmitted from the music data providing apparatus; and reproducing the section data file transmitted from the music data providing apparatus.

13. The music data receiving method according to claim 12, further comprising:

storing, in a storage unit, the plurality of section data files constituting the music data for the piece of music transmitted from the music data providing apparatus; and separately reproduce the plurality of section data files stored in the storage unit in accordance with a section selecting operation on the screen.

* * * * *

UNITED STATES PATENT AND TRADEMARK OFFICE

CERTIFICATE OF CORRECTION

PATENT NO. : 6,700,049 B2
DATED : March 2, 2004
INVENTOR(S) : Togashi

It is certified that error appears in the above-identified patent and that said Letters Patent is hereby corrected as shown below:

Column 7,
Lines 18-19, change "files music data for a piece of music has been distributed corresponding" to -- files corresponding --.

Column 8,
Line 50, change "reproduce a the" to -- reproduce the --.

Column 9,
Line 23, change "data:" to -- data; --.

Column 10,
Line 6, change "screen:" to -- screen; --.

Signed and Sealed this

Fifteenth Day of June, 2004

JON W. DUDAS
*Acting Director of the United States Patent and Trademark Office*